US008502671B2

(12) United States Patent
Marcovici

(10) Patent No.: US 8,502,671 B2
(45) Date of Patent: Aug. 6, 2013

(54) ITEM DISPENSER AND TRACKER

(75) Inventor: Sorin Marcovici, Lexington, MA (US)

(73) Assignee: Analogic Corporation, Peabody, MA (US)

( * ) Notice: Subject to any disclaimer, the term of this patent is extended or adjusted under 35 U.S.C. 154(b) by 350 days.

(21) Appl. No.: 12/846,963

(22) Filed: Jul. 30, 2010

(65) Prior Publication Data

US 2012/0025981 A1 Feb. 2, 2012

(51) Int. Cl.
*G08B 13/14* (2006.01)

(52) U.S. Cl.
USPC ..... 340/572.1; 340/540; 340/572.8

(58) Field of Classification Search
USPC ..... 340/540, 572.1
See application file for complete search history.

(56) References Cited

U.S. PATENT DOCUMENTS

| | | | | |
|---|---|---|---|---|
| 7,715,277 | B2 * | 5/2010 | de la Huerga | 368/10 |
| 2002/0027507 | A1 * | 3/2002 | Yarin et al. | 340/573.1 |
| 2005/0285746 | A1 * | 12/2005 | Sengupta et al. | 340/573.1 |
| 2006/0061472 | A1 * | 3/2006 | Lovoi et al. | 340/572.1 |
| 2007/0194890 | A1 * | 8/2007 | Brue | 340/309.16 |
| 2009/0009332 | A1 * | 1/2009 | Nunez et al. | 340/572.1 |
| 2010/0052900 | A1 * | 3/2010 | Covannon et al. | 340/539.12 |
| 2011/0291078 | A1 * | 12/2011 | Hwang et al. | 257/40 |

OTHER PUBLICATIONS

Alert One, MedReady Automated Medication Dispenser, downloaded Jul. 29, 2010, 2 sheets, http://www.alert-1.com/Alert-One-MedReady--Automated-Medication-Dispenser.aspx.

E-Pill, Pill Bottle Multi Alarm, downloaded Jul. 29, 2010, 2 sheets, http://www.medicalwatches.com/thepilltimer.html.

E-Pill, CompuMed Temper Proof Automatic Pill Dispenser with Key, downloaded Jul. 29, 2010, 1 sheet, http://www.amazon.com/CompuMed%C2%AE-Tamper-Proof-Automatic-Dispenser/dp/B001LNYFDS.

E-Pill, Weekly Medication Reminder and Organizer, downloaded Jul. 29, 2010, 3 sheets, http://www.epill.com/weeklymed.html.

* cited by examiner

*Primary Examiner* — Kerry McNally
(74) *Attorney, Agent, or Firm* — Driggs, Hogg, Daugherty & Del Zoppo Co., LPA

(57) ABSTRACT

An item tracking apparatus includes a tag interrogator that transmits an interrogation signal and receives a signal emitted by a tag affixed to an item in response to the tag receiving the interrogation signal, wherein the tag and item are part of a bio-compatible consumable dosage delivery unit and a controller that determines a state of the item based on the received signal. A consumable dosage delivery unit includes a dosage form and a bio-compatible wireless communications tag.

37 Claims, 3 Drawing Sheets

ITEM DISPENSER AND TRACKER

TECHNICAL FIELD

The following generally relates to dispensing and tracking an item having a tag with wireless communication capabilities, and is described with particular application to dispensing and tracking a bio-compatible consumable dosage form (e.g., a pill, a capsule, a tablet, a caplet, a softgel, or the like) with a bio-compatible tag affixed thereto. However, the following is also amenable to any item to be obtained and utilized based on a predetermined schedule or regime where the prescribed use of the item results in a change in a signal provided by the wireless communication of the tag affixed to the item.

BACKGROUND

Often times medications, supplements, and the like are packaged in a consumable dosage form to be orally administered. Examples of such dosage forms include, but are not limited to, pills, capsules, tablets, caplets, softgels, and the like. In some instances, a subject is prescribed multiple different medications, supplements, and the like packaged in one or more of the above-noted dosage forms, where each of the medications, supplements, and the like is prescribed to be taken multiple times during a day based on individual and different schedules. In such an instance, the subject is tasked with remembering and following the schedules. Unfortunately, in some instances, the number of different medications, supplements, and the like may make it difficult for the subject to keep track of what they have taken, when they took it, how many they took, and when the next scheduled medications, supplements, and the like is to be taken. As such, a prescribed dosage may be missed or consumed in error.

One way to manage such schedules is through a pill box. Generally, a pill box is a special container made with compartments for each day of the week, and sometimes with compartment sections for different times of the day. With a pill box, the user, a care giver, a family member or other person fills the different compartments and sections according to a prescribed schedule. The user then obtains the appropriate dosage and dosage form(s) at the scheduled time through the corresponding compartment and/or compartment section. Electronic pill boxes can be programmed to automatically discharge dosage forms to the user, and some electronic pill boxes have alarms to alert the user at scheduled times. Such pill boxes have been viewed as a way to prevent or reduce dosage errors, and are well suited for the elderly and others with memory deficiencies and those taking multiple dosages multiple times a day.

The foregoing pill boxes allow a subject to know whether or not they were in physical possession of a scheduled dosage. For example, where a pre-filled compartment or compartment section still contains the dosage, the user or caregiver knows the dosage has not been administered, and where the pre-filled compartment or compartment section is now empty, the user or caregiver knows that the dosage has been removed and assumes that the dosage has been properly administered. Unfortunately, even though the user may have been in physical possession of the proper dosage at the proper time, the user may not have consumed the dosage. As a consequence, although pill boxes facilitate obtaining physical possession of the proper dosage at the schedule time, dosage forms may still be missed or taken in error. For example, the user may set the dosage down form and not remember or incorrectly remember whether or not they actually consumed the dosage form.

SUMMARY

Aspects of the application address the above matters, and others.

In one aspect, an item tracking apparatus includes a tag interrogator that transmits an interrogation signal and receives a signal emitted by a tag affixed to an item in response to the tag receiving the interrogation signal, wherein the tag and item are part of a bio-compatible consumable dosage delivery unit and a controller that determines a state of the item based on the received signal.

In another aspect, a consumable dosage delivery unit includes a dosage form and a bio-compatible wireless communications tag.

In another aspect, a method includes transmitting a tag interrogation signal, waiting for a response signal emitted by a tag in response to receipt of the tag interrogation signal by the tag, wherein the tag is a bio-compatible consumable tag affixed to an item of a consumable dosage deliver unit, and generating a first signal indicating that the consumable dosage deliver unit has been consumed by a user in response to receiving no response signal within a predetermined time window and a second signal indicating that the consumable dosage deliver unit has not been consumed by the user in response to receiving the response signal within the predetermined time window.

In another aspect, a system includes a container including at least one item to dispense, wherein the container includes an electronic tag storing information about the at least one item, an item tracking apparatus that reads the information about the at least one item from the electronic tag of the container and selectively programs the item tracking apparatus to dispense the at least one item based on a predetermined schedule when the at least one item is transferred to the item tracking apparatus, and a remote computing system that at least one of communicates a signal including information about the at least one item to the item tracking apparatus or receives a signal including information about the at least one item to carried by the item tracking apparatus from the item tracking apparatus.

Those skilled in the art will recognize still other aspects of the present application upon reading and understanding the attached description.

BRIEF DESCRIPTION OF THE DRAWINGS

The application is illustrated by way of example and not limitation in the figures of the accompanying drawings, in which like references indicate similar elements and in which.

DETAILED DESCRIPTION

Figure 1:
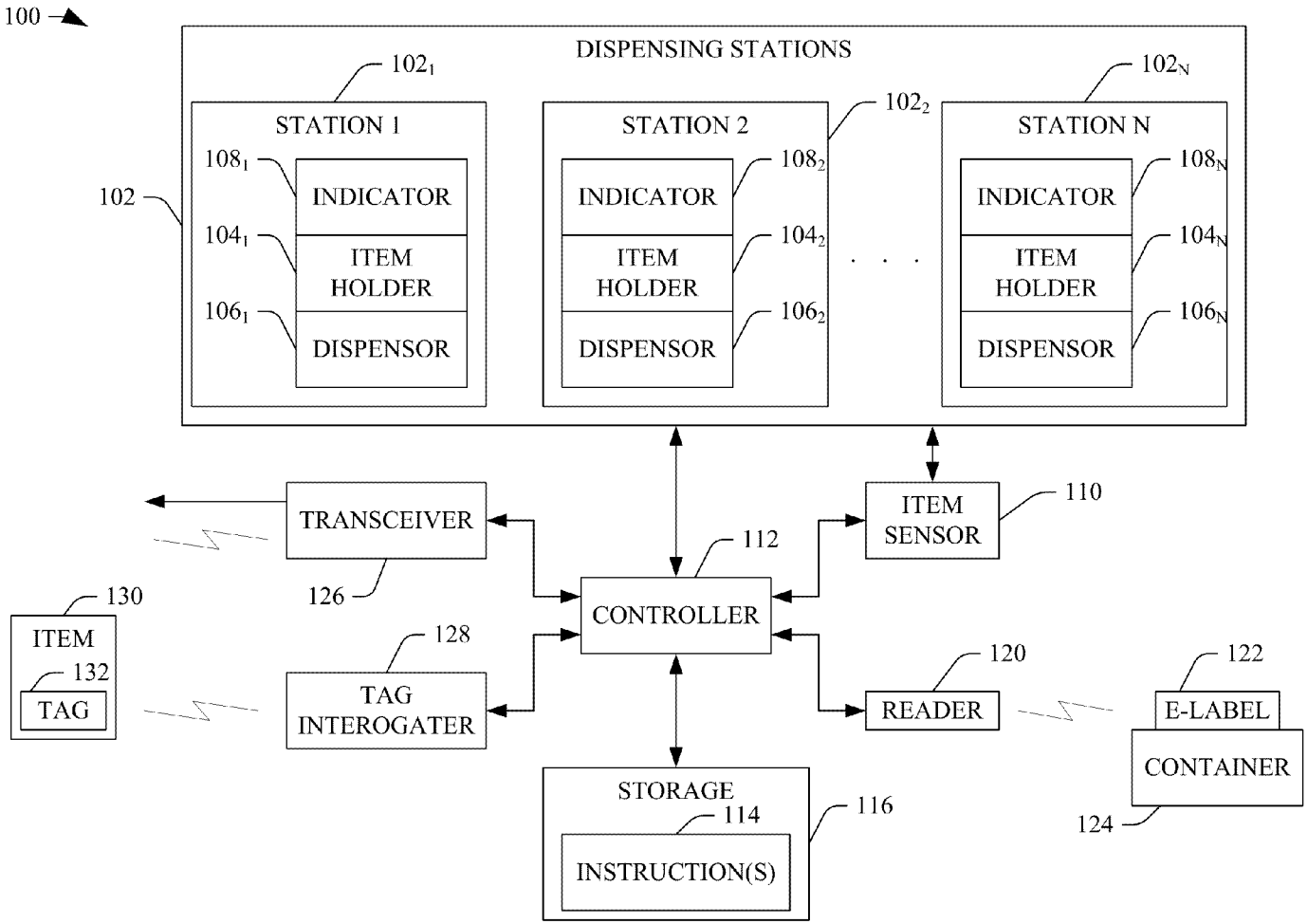
FIG. 1 illustrates an item tracking apparatus in connection with an item dispensed by the apparatus.

FIG. 1 illustrates an item tracking apparatus 100 in connection with an item 130 having a wireless communication tag 132 affixed thereto.

The apparatus 100 includes dispensing stations $\mathbf{102}_1$, $\mathbf{102}_2, \ldots, \mathbf{102}_N$ (where N is an integer equal to or greater than one), collectively referred to herein as dispensing stations 102. Each of the stations $\mathbf{102}_1$, $\mathbf{102}_2, \ldots, \mathbf{102}_N$ includes an item holder $104_1$, $104_2$, . . . , $104_N$, collectively referred to herein as item holders 104. Each of the item holders 104 includes a container with a material free inner volume and one or more ingress regions and one or more egress regions. The ingress region(s) allows for entry of one or more items into a holder 104, which holds the one or more items, and the egress region(s) allows for exit of one or more of the items from the holder 104.

Each of the stations $102_1$, $102_2$, . . . , $102_N$ further includes a dispenser $106_1$, $106_2$, . . . , $106_N$, collectively referred to herein as dispensers 106. Each of the dispensers 106 is in mechanical communication with a corresponding one of the holders 104. For example, each of the dispensers 106 is in mechanical communication with the one or more egress regions of the corresponding one of the holders 104. The dispensers 106 provide controlled access to the items in the item holders 104, for example, for retrieval of one or more items by a human, animal, robot, or the like.

An item sensor 110 sensing information about the content of each of item holders 104. For example, in one embodiment the item sensor 110 senses information indicative of the number of items in an item holder 104. Such information may include a count of the number of items in a holder, a weight of the items in the holder 104, a height or volume of the holder 104 filled by items, and/or other information that can be used to determine whether an item is in a holder 104 and/or how many items, if any, are in the holder 104. In the illustrated embodiment, a single item sensor 110 senses such information. However, in another embodiment at least one of the stations 102 has a dedicated item sensor 110.

A controller 112 controls the dispensing stations 102, for example, based on one or more instructions 114 in storage 116. Such instructions, when executed by the controller 112, may cause the controller 112 to instruct the stations 102 to dispense a predetermined quantity of items at one or more scheduled times. Additionally or alternatively, the instructions may cause the controller 112 to instruct the stations 102 to transition to a state in which items can be loaded in one or more of the holders 104. Additionally or alternatively, the instructions may cause the controller 112 to instruct the indicators 108 to present certain information. The controller 112 may include one or more micro-processors and/or work in conjunction with one or more local or remote (including distributed) micro-processors. It is to be appreciated that the various components (e.g., a dispensing station) of the apparatus 100 may transition into an idle or sleep state when not being used, and the controller 112 selectively wakes or activates one or more of the components of the apparatus 100 as needed.

A reader 120 reads information stored in an electronic label (e-label) 122 affixed to a container 124, such as a container holding items to be loaded into one of more of the holders 104. The e-label may be programmed with various information such as a type of the item, a dispensing schedule (e.g., how many, how often, etc.) for the item, an expiration date of the item, a prescriber of the items, a supplier of the items, a user of the items, and/or other information. In the illustrated embodiment, the reader 120 communicates with the e-label 122 through wireless communication, which may include optical (e.g., bar code), radiofrequency (RF), infrared, and/or other electromagnetic communication. In another embodiment, at least a portion of the information can be manually provided to the reader 120 via a graphical user interface, keyboard, mouse, and/or other input device. Read instructions can be stored in the storage 118 and/or utilized by the controller 112.

A transceiver 126 is configured for communication with one or more other devices. In the illustrated embodiment, such communication includes wireless communication. In another embodiment, the communication is through non-wireless communication and/or wireless communication. Examples of such communication include, but are not limited to, cellular, telephone line, Internet, satellite, email, text message, instant message, optical fiber, and/or other communication. In the illustrated embodiment, transceiver 126 includes at least one transmitter and at least one receiver for concurrent or individual uni or bi-directional communication. In another embodiment, the transceiver 126 includes either a transmitter or a receiver, and is configured only for unidirectional communication.

A tag interrogator 128 is configured to interrogate and wirelessly communicate with the tag 132, which has complementary wireless communication. As described in greater detail below, in one non-limiting embodiment the item 130 and tag 132 are part of a dosage delivery unit and the tag 132 is bio-compatible tag and consumable by a human or animal. With this embodiment, the tag 132 may include a passive radiofrequency identification (RFID) tag formed from a bio-compatible material and electrically conductive bio-compatible particles, such as gold, copper, silver, and/or other electrically conductive material, which act as an antenna or the like for receiving the interrogation signal and emitting the characteristic electromagnetic radiation. The conductive particles can be patterned for communicating in one or more predetermined frequency ranges of the electromagnetic spectrum, and different patterns can correspond to different types of items in a known manner. Such a tag can store and communicate various information about the item 130. In other embodiments, the tag 132 may additionally or alternatively include an active RFID tag, an optical tag, and/or other tag.

Each of the stations $102_1$, $102_2$, . . . , $102_N$ further includes an indicator $108_1$, $108_2$, . . . , $108_N$, collectively referred to herein as indicator 108. The indicators 108 can be used to provide information about the stations 108, including information about the item holders 104 and/or the dispensers 106. For example, an indicator 108 may be used to present a notification (e.g., visual, audible, tactile, etc.) about a state of a holder 104 (e.g., empty, full, somewhere in between), a message indicating that an item should be removed from the dispenser 106, a message indicating that an item was removed from the dispenser 106, etc. In another embodiment, more than one of the stations 102 utilizes, concurrently and/or individually, the same one or a common or shard one of the indicators 108.

An indicator 108 may also be used to present various alarms. In one instance, an alarm is provided where an item is dispensed and the signal emitted by a tag affixed thereto is still received after a predetermined period of time. Such an alarm may facilitate mitigating instances in which the user places the dispensed item down and forgets about it. The alarm may remind the user and/or bring to the attention of the user that the item has not been consumed. Another alarm indicates that the signal diminished too quickly. This may correspond to an instance in which the item is dropped in a glass of water or the signal emitted therefrm is otherwise abruptly attenuated. Another alarm may follow after lapse of a predetermined time period if a replacement item is not dispensed or the signal emttied from the early dispensed item is not sensed.

During operation of the apparatus 100, the tag interrogator 128 transmits (via a transmitter portion) an interrogation signal and receives (via a receiver portion) characteristic electromagnetic radiation emitted by the tag 132 in response to the tag 132 receiving the interrogation signal. The controller 112 can variously employ the received characteristic electromagnetic radiation. For example, in one instance mere reception of the characteristic electromagnetic radiation can be used to detect the presence of the tag 132 and hence the item 130 in an interrogation region of the interrogator 128, absence of reception of the radiation within a predetermined time during can be used to determine absence of the item 130 from the interrogation region, and a diminishing level of received radiation can be used to indicate that the tag 132 is breaking down or otherwise located in a region attenuating the signal and hence the item 130 is likely being utilized in a prescribed manner.

Generally, the tag 132 can be used with any item prescribed or desired to be obtained by a user based on a predetermined schedule or regime in which prescribed use of the item results in breakdown of the tag 132. Moreover, the tag 132 can be used in applications in which the item 130 is not obtained from and/or dispensed by the dispensing station 102, but otherwise obtained. With such an application, the dispensing station 102 may be omitted from the dispensing apparatus 100. It is to be appreciated that the tag 132 can be affixed to items that can be consumed by subjects and items that are not consumed by subjects.

FIGS. 2-5 illustrate various non-limiting examples of the item 130 with the tag 132.

Figure 2:
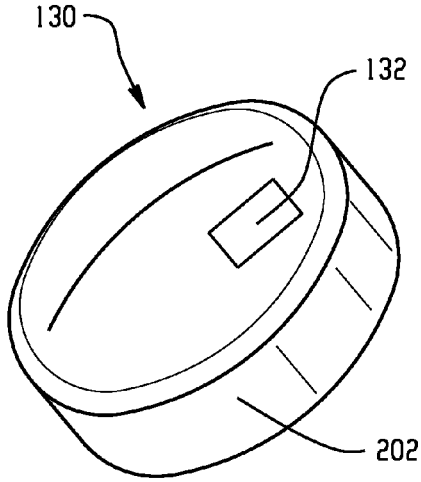
FIGS. 2-5 illustrate non-limiting examples of suitable items with tracking tags.

In FIG. 2, the item 130 and tag 132 are part of the consumable dosage delivery unit that is orally ingestible or consumed and is packaged as a pill or tablet 202. Other suitable packages include, but are not limited to, a capsule, a caplet, softgel, and/or other medical package. In this example, the tag 132 may hold information such as a name of a medication or supplement, an expiration date, a prescribing physician, a source pharmacy, a patient name, an item administration schedule, a number of refills remaining, and/or other information about related to the prescription, item 130, etc.

The illustrated tag 132 is bio-compatible and formed from silk or the like and includes nano-scale electrically conductive particles. The conductive particles are configured to communicate in the terahertz (THz) range. Such a range may be well suited for oral applications since signals in this range will relatively slowly attenuate once placed in the mouth so that the signal emitted by the tag 132 can be used to determine whether the tag 132 and hence item 202 is likely to be outside of the mouth, inside the mouth, consumed, or otherwise broken down. For the latter, an abrupt drop in signal may indicate that item has been dropped in a glass of water or other higher attenuating fluid or container by the relatively fast drop in signal intensity, level, strength, presence, etc.

Various techniques can be used to affix the tag 132 to the item 202. By way of example, the tag 132 may be affixed to the item 202 via any technique for applying a thin film to a substrate such as a process incorporating spin coating, printing (e.g., droplet printing, etc.) or other technique. With spin coating, generally, the tag 132 is placed on the item 202, the item 202 is rotated at a high speed, and the tag 132 spreads over a region of the item 130 via centrifugal force until a predetermined thickness of material is reached. Note that in FIG. 2 the relative size of the tag 132 to the item 202 is provided for explanatory purposes and is not limiting.

Figure 3:
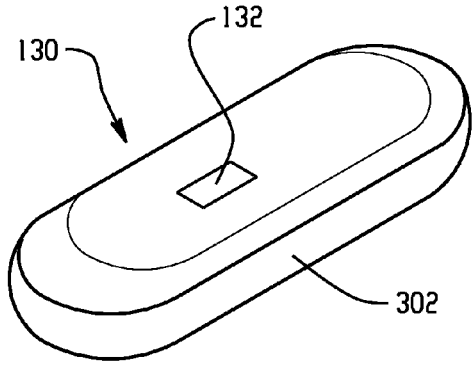
Figure 4:
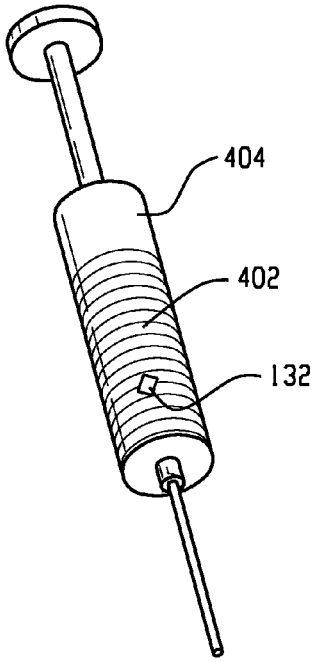

In FIG. 3, the item 130 is packaged as a suppository 302 and the tag is affixed thereto. In FIG. 4, the tag 132 is added to an item 132 such as a fluid 402 (e.g., insulin) loaded into a container 404 such as a syringe. In this case, a dispensing station 102 may dispense a pre-loaded syringe and/or a vial containing the fluid 402, which can subsequently be added to the syringe. With both of these embodiments, the tag 132 can be utilized as described herein to track whether or not the item 132 has likely been administered or has not been administered. Other suitable administration routes include, but not limited to, oral, ocular, otologic, nasal, urogenital, enteral, dermal, injection, transfusion, and/or other administration routes.

Figure 5:
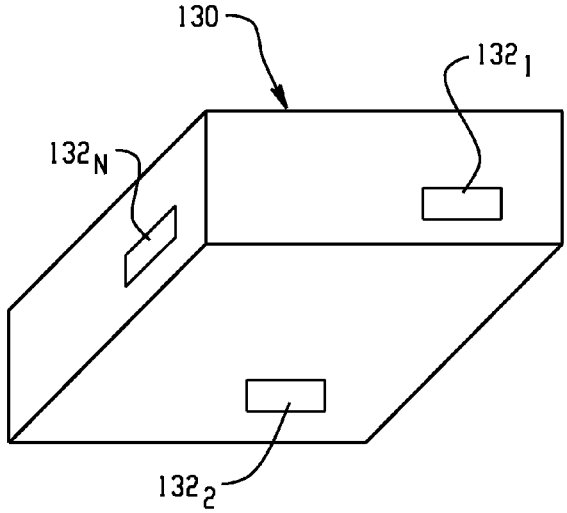

In FIG. 5, the item 130 includes multiple tags 132, such as N tags $\mathbf{132}_1, \mathbf{132}_2, \ldots, \mathbf{132}_N$. With this embodiment, the tags 132 are affixed in predetermined regions of the item 130. This embodiment may be well suited for applications in which one or more of the regions may be disturbed such that the tags 132 disposed therein are prematurely broken down, while one or more other tags 132 can still emit until the desired event causes the tags 132 to break down.

It is to be appreciated that the items of FIGS. 2-5 are provided for explanatory purposes and are not limiting, and other consumable and/or non consumable items are also contemplated herein.

Figure 6:
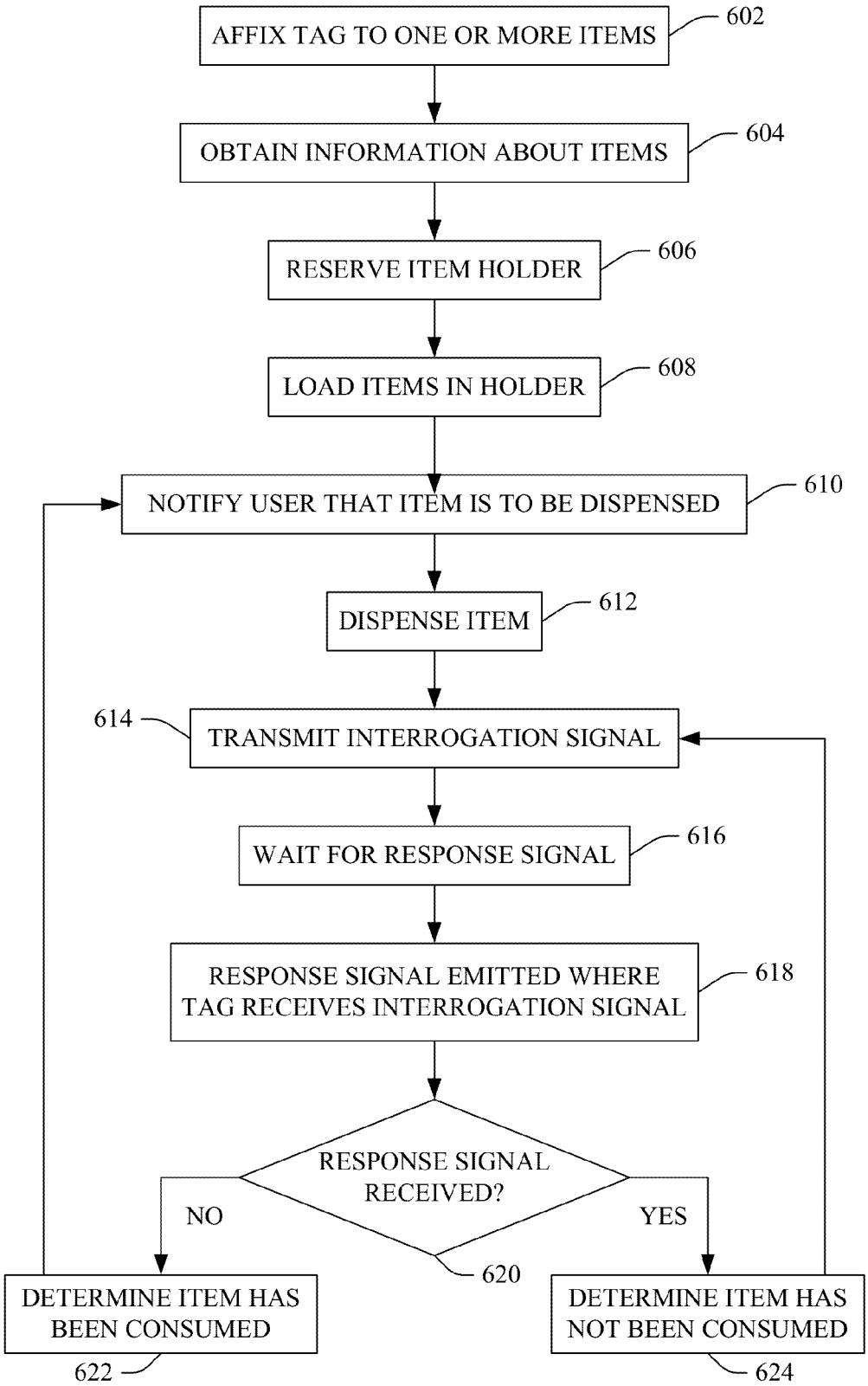
FIG. 6 illustrates non-limiting method.

FIG. 6 illustrates a method a method for tracking an item 130 via the tag 132 affixed thereto. Note that the order of the following acts is not limiting, and in other embodiments, the ordering may differ, and other acts may be added and/or one or more acts may be omitted.

For explanatory purposes and sake of brevity, the following is described in the context of a bio-compatible consumable dosage unit including a tag affixed to a dosage form item scheduled to be orally administered to a subject based on a prescribed scheduled.

At 602, a tag is respectively affixed to a plurality of the dosage form items.

At 604, information about the dosage form items is obtained by the dispensing apparatus 100.

At 606, an item holder 104 of the dispensing apparatus 100 is reserved for the dosage form items.

At 608, the dosage form items are loaded into the reserved item holder 104.

At 610, the dispensing apparatus 100 notifies a user via the indicator 108 when a dosage form item is scheduled to be dispensed to the user.

At 612, the dispensing apparatus 100 dispenses the dosage form item to the user.

At 614, the dispensing apparatus 100 transmits a tag interrogation signal.

At 616, the dispensing apparatus 100 waits for a response signal.

At 618, where the tag receives the interrogation signal, the tag emits the response signal.

At 620, it is determined whether a response signal is received by the dispensing apparatus 100 within a predetermined time window.

At 622, if not, the dispensing apparatus 100 determines the bio-compatible consumable dosage form unit has likely been consumed. In this instance, the dispensing apparatus 100 can present information via the indicators 108 indicating that the bio-compatible consumable dosage form unit has been consumed, and, if any more bio-compatible consumable dosage form units are scheduled to be dispensed, acts 610 and on are repeated.

At 624, if so, the dispensing apparatus 100 determines that the bio-compatible consumable dosage form unit has not been consumed. In this instance, the dispensing apparatus 100 can present information via the indicator 108 indicating that the bio-compatible consumable dosage has not been consumed and acts 614 and on are repeated.

The following presents an example use-case scenario in which a pharmacy fills multiple prescriptions for medications in pill form and that include the tag 132 for a subject and the subject uses the tracking apparatus 100 to dispense and track administration of the pills via the tag 132.

Initially, a doctor writes a prescription for the medication for the subject. The subject takes his prescriptions to the pharmacy to be filled. The pharmacist or other authorized fills individual pill containers with the medications based on the prescription such that each container includes the prescribed number of pills having the prescribed dosage. An electronic label is prepared and affixed to each pill container. The electronic label may include information such as pill identification, the number of pills, the dosage of each pill, and/or other information. The electronic label may subsequently be used to verify that the proper medication is in each container, that correct information is on each pill container, that there are no conflicts between the medications, and/or other information.

In this example, the electronic label is scanned at the pharmacy, and a computing device communicates with the transceiver 126 of the dispensing apparatus 100. Such communication can be via telephone line, cell tower, the Internet, etc. The information provided to the transceiver 126 allows the controller 112 to pre-configure the dispensing apparatus 100. By way of example, the controller 112 can locate and assign available stations 102 for each of the medications, store the prescribed frequency for each medication in the storage 114, etc. An available station 102 can be found based on a list of the state of the various stations 102 stored in the storage 118 and/or via the item sensor 110, which can determined whether a station 102 is currently being used or not.

Once at the location where the dispensing apparatus 100 is located, the user scans the electronic label of one of the containers via the reader 120 of the dispensing apparatus 100. This can be achieved by the user placing the electronic label within the reading path or range of the reader 120. The controller 112 identifies the station 102 assigned to the medication corresponding to the read electronic label 122. The controller 112 employs the corresponding indicator 108 to notify the user, via a visual and/or audible notification, which station has been assigned to the medication. The controller 112 may also send a signal to the corresponding stations 108, and in response, the station 108 provide access to the ingress region of the holding volume of the item holder 104. For example, a door or cover blocking an opening into the holder 104 may transition from one position to another, exposing the opening into the holder 104.

Upon emptying the medication into the holder 104, the controller transitions the door or cover back to the position in which the ingress region is no longer accessible. The user may manually invoke or close the door, or the dispensing apparatus 100 may automatically determine when to close the door, for example, based on the number of pills entering the holder 104, a weight of the content of the holder 104, a height of the holder 104 occupied by the medication, a expired timer started when the door was first opened, and/or otherwise. As discussed herein, the item sensor 110 can determine some of the above triggers for closing the door. The foregoing is done for each of the filled prescriptions.

Once the user has loaded the dosage forms into the dispensing apparatus 100, the user activates the dispensing apparatus 100 to notify and dispense the loaded medications based on the stored prescribed schedule. A confirmation signal indicating successful loading of the item holders 104 can be sent back to the pharmacy and/or provided to the user. When the prescribed schedule stored in the storage 116 indicates that one or more loaded medications should be taken, the controller 112 invokes the corresponding indicators 108 to present a visual and/or audile notification. The information provided by the indicators 108 may include an indication that a pill is to taken, the number of pills to be taken, how the pill should be taken (e.g., with or without food and/or beverage), etc. The controller 112 may also employ the transceiver 126 to notify the user, the pharmacy, the prescribing physician and/or other via telephone, cell phone, pager, set top box connected to a television, email, and/or other communication channel.

Upon the user retrieving the item(s) from the dispenser(s) 106, the tag interrogator 128 is employed. In this example, the tag interrogator 128 transmits, after dispensing of the item, an interrogation signal. The tag 132, in response to receiving the signal, emits a signal, which is received by the interrogator 128 and conveyed to the controller 112. The controller 112 uses various characteristics of the signal to determine the state of the signal. For example, in one instance, mere reception of the signal by the tag interrogator 128 means that the medication has not been fully ingested yet. In another instance, a gradually decreasing signal level or strength may indicate that the medication has been placed in the user's mouth and the tag 132 is breaking down. In another instance, a more abrupt decrease signal level or strength may indicate that the medication has been taken out of the interrogation region, dropped in a glass of water, and/or in a situation where the tag signal is not longer within the interrogation range or where the tag breaks down relatively quickly.

The controller 112 may employ the indicators 108 and/or the transceiver 126 to notify the user more than once and/or over a predetermined time duration that sensed signal still indicates that the medication has not been taken. This may facilitate mitigating a user putting the medication down and forgetting that they did not take the medication or falsely believe that they took the medication. Once the tag signal is no longer received by the tag interrogator 128, the controller 112 can invoke the indicators 108 and/or the transceiver 126 to notify the user one or more times that the dispensing apparatus believes the user has taken the medication. Upon lapse of time, a manual confirmation by the user, and/or other criteria, the controller 112 ceases or stops sending messages regarding the medication just dispensed and transitions back into a mode or state in which the above is repeated upon the next scheduled medication time.

It is to be appreciated that the dispensing apparatus 100 can also communicate other information with the pharmacy and/or other source filling the prescription. For example, upon the prescription information being provided to the dispensing apparatus 100 from the computer at the pharmacy, the dispensing apparatus 100 may provide a confirmation signal. Further, the controller 112 may employ the transceiver 126 to notify the pharmacy that an item holder 104 is empty or near empty, for example, where the prescription information conveyed to the dispensing apparatus indicates that there is at least one refill left. In this manner, the pharmacy can pre-prepare the refill and/or notify the user regarding the state of the medication in the holder 104. Of course, this same information can be provided to the user via the indicators 108 and/or the transceiver 128.

For the above, the controller 112 may determine that a holder 104 is near empty or empty based on various information. By way of example, in one instance the controller 112 predicts that a holder 104 is near empty or empty based on the number of pills and frequency specified on the prescription information sent to the dispensing apparatus 100. In another instance, the controller 112 determines that a holder 104 is near empty or empty based on the information (e.g., number of pills, weight, height of medication in holder 104, etc.) sensed by the item sensor 110. The user may also provide an input indicating that the dispensing apparatus 100 should contact the pharmacy about refilling a prescription.

The application has been described with reference to various embodiments. Modifications and alterations will occur to others upon reading the application. It is intended that the invention be construed as including all such modifications and alterations, including insofar as they come within the scope of the appended claims and the equivalents thereof.

What is claimed is:

1. An item tracking apparatus, comprising:

a tag interrogator that transmits an interrogation signal and receives a signal emitted by a tag affixed to an item in response to the tag receiving the interrogation signal, wherein the tag and item are part of a bio-compatible consumable dosage delivery unit;

a controller that determines a state of the item based on the received signal;

an item holder configured to hold the item; and a reader that reads electronic information about the item from an electronic tag on a container holding the item before the item is loaded in the holder.

2. The item tracking apparatus of claim 1, wherein the item is a medicine or a supplement prescribed to be taken by a user in accordance with a predetermined schedule.

3. The item tracking apparatus of claim 1, wherein the state indicates at least one of: the item has been consumed, the item is being consumed, or the item has not been consumed by a human or animal consumer of the item.

4. The item tracking apparatus of claim 1, further comprising:

an indicator that at least one of visually or audibly presents information indicative of the state of the item.

5. The item tracking apparatus of claim 4, further comprising:

a dispensing station, including:

an item dispenser for dispensing the item in the item holder.

6. The item tracking apparatus of claim 5, wherein the indicator indicates, at least of: it is time to dispense the item or the item has been dispensed.

7. The item tracking apparatus of claim 5, further comprising:

a controller that invokes the item dispenser to dispense an item based on prescribed item dispensing schedule.

8. The item tracking apparatus of claim 7, wherein the schedule is based on a medical prescription.

9. The item tracking apparatus of claim 5, further comprising:

an item sensor that determines information about items in the item holder.

10. The item tracking apparatus of claim 9, wherein the information is indicative of whether the item holder is empty, near empty, or filled to at least a predetermined level with items.

11. The item tracking apparatus of claim 10, wherein the item sensor determines the information based on a number of items in the holder, a weight of the items in the holder, or a height level of the items in the holder.

12. The item tracking apparatus of claim 1, wherein the consumable dosage delivery unit is part of a pill, a capsule, a tablet, a caplet, a softgel, or other medical package.

13. A consumable dosage delivery unit, comprising:

a dosage form; and a bio-compatible wireless communications tag, wherein a container holding the consumable dosage delivery unit includes an electronic tag that is read by a reader of a dispenser that will dispense the consumable dosage delivery units before the consumable dosage delivery unit is loaded in the dispenser;

wherein the tag includes silk and electrically conductive nano-particles utilized as an antenna; and wherein the conductive nano-particles are patterned for communication in the terahertz range of the electromagnetic spectrum.

14. The consumable dosage delivery unit of claim 13, wherein the dosage form is a pill, a capsule, a tablet, a caplet, a softgel, or other medical package.

15. The consumable dosage delivery unit of claim 13, wherein the dosage form is configured to be administered by way of at least one of oral, ocular, otologic, nasal, urogenital, enteral, dermal, injection, or transfusion routes.

16. The consumable dosage delivery unit of claim 13, wherein the electronic tag includes a radio frequency identification tag.

17. The consumable dosage delivery unit of claim 16, wherein the electronic tag stores information about the dosage form.

18. The consumable dosage delivery unit of claim 17, wherein the information includes one or more of a type of consumable dosage delivery unit, a prescribing physician, a patient identification, a prescribed dosage, a number of refills, a frequency of consumption, or a prescription fulfilling pharmacy.

19. The consumable dosage delivery unit of claim 13, wherein the conductive nano-particles includes gold, silver, and/or other electrically conductive material.

20. The consumable dosage delivery unit of claim 13, wherein the tag breaks down in the presence of a bodily fluid.

21. The consumable dosage delivery unit of claim 20, wherein a signal emitted by the tag diminishes as the tag breaks downs.

22. A method, comprising:

matching information read from a tag of a container holding a consumable dosage deliver unit with information provided by a remote computing system;

conveying a signal to the remote computing system indicating whether the information matches;

transmitting, via a transmitter, a tag interrogation signal;

waiting for a response signal emitted by a tag in response to receipt of the tag interrogation signal by the tag, wherein the tag is a bio-compatible tag affixed to an item of a consumable dosage deliver unit; and generating a first signal indicating that the consumable dosage deliver unit has been consumed by a user in response to receiving no response signal within a predetermined time window and a second signal indicating that the consumable dosage deliver unit has not been consumed by the user in response to receiving the response signal within the predetermined time window.

23. The method of claim 22, further comprising:

presenting at least one of a visual or audible notification indicative of whether the consumable dosage delivery unit has or has not been consumed based on the first and second signals.

24. The method of claim 23, further comprising:

generating a third signal indicating that the consumable dosage deliver unit is being consumed in response to a level of the received response signal being within a predetermined level range.

25. The method of claim 22, wherein the tag is applied to the item through spin coating or printing.

26. The method of claim 22, further comprising:

notifying a user that it is time to consume the consumable dosage deliver unit.

27. The method of claim 22, further comprising:

dispensing the consumable dosage deliver unit from a dispenser to the user.

28. The method of claim 27, further comprising:

notifying a remote source of the consumable dosage deliver unit that the dispenser is to be refilled with at least one more consumable dosage deliver unit.

29. A system, comprising:

a container including at least one item to dispense, wherein the container includes an electronic tag storing information about the at least one item;

an item tracking apparatus that reads the information about the at least one item from the electronic tag of the container and selectively programs the item tracking apparatus to dispense the at least one item based on a predetermined schedule when the at least one item is transferred to the item tracking apparatus; and a remote computing system, of a source of the item, that at least one of communicates a signal including information about the at least one item to the item tracking apparatus or receives a signal including information about the at least one item to carried by the item tracking apparatus from the item tracking apparatus, wherein the item tracking apparatus assigns a dispensing station of the item tracking apparatus for the at least one item before the at least one item is placed in the item tracking apparatus based on the signal from the remote computing system.

wherein the item tracking apparatus assigns a dispensing station of the item tracking apparatus for the at least one item before the at least one item is placed in the item tracking apparatus based on the signal from the remote computing system.

30. The system of claim 29, the item tracking apparatus, comprising:

a reader that reads the information about the at least one item from the electronic tag of the container;

a controller that selectively programs the item tracking apparatus to dispense the at least one item based on the read information;

at least one dispenser that carries and dispenses the item based on the predetermined schedule from the read information;

a notification component that presents a notification when it is time for the item to be dispensed; and a transmitter that interacts via wireless communication with an electronic tag affixed to the item once the item is dispensed from the item tracking apparatus.

31. The system of claim 29, wherein the remote computing system provides the predetermined schedule to the item tracking apparatus.

32. The system of claim 29, further comprising:

a controller that matches the information read from the tag of the container with the information provided by the remote computing system.

33. The system of claim 32, wherein the item tracking apparatus conveys a signal to the remote computing system indicating whether the information matches.

34. The system of claim 29, wherein the item tracking apparatus conveys a signal to the remote computing system indicating that a predetermined number of the at least one item has been dispensed.

35. The system of claim 29, wherein the item tracking apparatus conveys a signal indicating an item scheduled to be dispensed has not been dispensed.

36. The system of claim 29, wherein the item tracking apparatus presents an alarm indicating an item scheduled to be dispensed has not been dispensed.

37. The system of claim 29, wherein the item tracking apparatus presents an alarm indicating an item scheduled to be dispensed has not been consumed based on communication between the item dispensing apparatus and an electronic tag affixed to the dispense item.

* * * * *